US007870885B2

(12) United States Patent
Wessen et al.

(10) Patent No.: US 7,870,885 B2
(45) Date of Patent: Jan. 18, 2011

(54) METHOD OF AND A DEVICE FOR PRODUCING A LIQUID-SOLID METAL COMPOSITION

(76) Inventors: Magnus Wessen, Norra Barrgatan 9, 554 46 Jönköping (SE); Haiping Cao, Havsörnsgatan 107/57, 556 11 Jönköping (SE)

( * ) Notice: Subject to any disclaimer, the term of this patent is extended or adjusted under 35 U.S.C. 154(b) by 402 days.

(21) Appl. No.: 11/792,580

(22) PCT Filed: Dec. 9, 2005

(86) PCT No.: PCT/SE2005/001889

§ 371 (c)(1),
(2), (4) Date: Aug. 23, 2007

(87) PCT Pub. No.: WO2006/062482

PCT Pub. Date: Jun. 15, 2006

(65) Prior Publication Data

US 2008/0118394 A1 May 22, 2008

(30) Foreign Application Priority Data

Dec. 10, 2004 (SE) ..... 0403001

(51) Int. Cl.
*B22D 27/00* (2006.01)
*B22D 27/04* (2006.01)

(52) U.S. Cl. ..... 164/57.1; 164/59.1

(58) Field of Classification Search ..... 164/55.1–59.1, 164/900; 266/235
See application file for complete search history.

(56) References Cited

U.S. PATENT DOCUMENTS

| | | | | |
|---|---|---|---|---|
| 1,548,614 | A * | 8/1925 | Konigsberg | 266/216 |
| 3,510,277 | A * | 5/1970 | Schmidt | 428/614 |
| 3,662,810 | A * | 5/1972 | Talbot et al. | 164/57.1 |
| 3,951,651 | A | 4/1976 | Mehrabian et al. | |
| 4,557,605 | A | 12/1985 | Kenney et al. | |
| 5,555,926 | A | 9/1996 | Uchimura et al. | |
| 6,547,850 | B1 | 4/2003 | Skibo et al. | |

(Continued)

FOREIGN PATENT DOCUMENTS

CN 1262334 8/2000

(Continued)

OTHER PUBLICATIONS

Maltsev M.V., Metallographya promyshlennych tsvetnych metallov I splavov, Metallurgiya, Moskva, 1970, c.30.

(Continued)

*Primary Examiner*—Kuang Lin
(74) *Attorney, Agent, or Firm*—Young & Thompson

(57) ABSTRACT

A method of producing a liquid-solid metal composition (8), including the steps of charging a vessel (2) with a molten metal or alloy (3), charging the vessel (2) with a solid metal or alloy (6), stirring the molten metal or alloy (3) upon cooling thereof. The amount of solid metal or alloy (6) is chosen such that a substantial amount of solid particles (7) will be formed in the melt (3) due to the enthalpy exchange between the solid metal or alloy (6) and the molten metal or alloy (3), and at least a part of the added solid metal or alloy (6) is melted by the heat transferred to it by the molten metal or alloy (3).

15 Claims, 2 Drawing Sheets

U.S. PATENT DOCUMENTS

| | | | |
|---|---|---|---|
| 6,645,323 | B2 | 11/2003 | Flemings et al. |
| 2004/0055727 | A1 | 3/2004 | Hong et al. |
| 2005/0011626 | A1 | 1/2005 | Saha et al. |

FOREIGN PATENT DOCUMENTS

| | | | |
|---|---|---|---|
| EP | 0 438 004 | A1 | 7/1991 |
| JP | 1-96342 | | 4/1989 |
| JP | 5-237611 | | 9/1993 |
| JP | 9-57399 | | 3/1997 |
| JP | 11-5142 | | 1/1999 |
| RU | 2220221 | | 12/2003 |
| RU | 2228235 | | 5/2004 |
| WO | 97/12709 | | 4/1997 |
| WO | 2004/027101 | A2 | 4/2004 |

OTHER PUBLICATIONS

Udkin V.S., Proisvodstvo I litye tsvetnyx metallov, Metallurgiya, Moskva, 1967, c. 185.

Russian Official Action in Corresponding Application 2007125606/02(027893) dated Dec. 8, 2009.

* cited by examiner

METHOD OF AND A DEVICE FOR PRODUCING A LIQUID-SOLID METAL COMPOSITION

TECHNICAL FIELD

The present invention relates to a method of producing a liquid-solid metal composition, comprising the steps of charging a vessel with a molten metal or alloy, charging the vessel with a solid metal or alloy, and stirring the molten metal or alloy upon cooling thereof.

The invention also relates to a device for implementing the inventive method.

The composition of the molten metal or alloy can be formed from a wide variety of metals or alloys, however in particular those that, when frozen from a liquid state without agitation, tend to form a dendritic or facetted growth morphology.

It should be realised that the molten metal or alloy need not be in a liquid state when being loaded into the vessel. It could as well be loaded in a solid state, and subsequently melted in order to achieve its liquid or largely liquid state. If so, the solid metal or alloy is loaded after the generation of the molten phase.

It should also be realised that, generally, the order in which the molten metal or alloy and the solid metal or alloy is charged into the vessel is optional.

BACKGROUND OF THE INVENTION

It is well known that components made from a semi-solid material possess great advantages over corresponding components produced in accordance with conventional processes. "Semi-solid" is referred to as a melt comprising a certain weight percentage of solid particles that have been generated upon cooling of the melt. The advantages of a cast component produced upon casting of such a material may be fewer defects, better mechanical properties, etc.

The production of metal components based on a semi-solid material normally includes the heating of a metal or alloy in a vessel to render it liquid, followed by the cooling of the molten material until it reaches a semi-solid state. Once the semi-solid state has been reached, the material may typically be cast in a mould or in a device for continuous casting for the formation of a product or a semi-product.

As they solidify, many metals and alloys are prone to form a so-called dendritic structure. However, since such structures have a negative effect on the thixotropic properties of the semi-solid material, they should be avoided if possible. According to the closest prior art, for example as disclosed in U.S. Pat. No. 6,645,323, such a formation of a dendritic structure upon cooling and solidification is avoided by means of agitation of the melt.

According to U.S. Pat. No. 6,645,323 the liquid, molten metal, is rapidly cooled under controlled conditions while it is agitated by rotating mechanical devices to form a desired thixotropic slurry. Other ways of inducing the agitation, for example by means of an electromagnetic stirrer, are also feasible. The agitation continues up to a certain point when a predetermined, small, fraction of solid material has been formed in the melt. Then the cooling continues without further agitation. When a given fraction of solid metal is obtained in the slurry, it is used in a casting operation.

However, the process according to this prior art needs external cooling of the melt, either by a cooling means provided on the outside of the vessel or by a cooling means provided in the melt, for example in the stirrer. Accordingly, prior art requires a control of the cooling, including temperature control, for the purpose of controlling the obtained fraction of solid material. This makes these prior art methods relatively slow and costly.

Prior art also teaches the addition of a solid metal or alloy to a melt, either as an inoculant for the promotion of nucleation or as an alloying means.

WO 2004027101 discloses a method for refining of primary silicon in hypereutectic alloys by mixing a hypereutectic alloy and a solid/semi-solid hypoeutectic alloy. The method provides control of the morphology, size, and distribution of primary Si in a hypereutectic Al—Si casting by mixing a hypoeutectic Al—Si liquid with one that is hypereutectic to impart desirable mechanical properties due to the formation of the primary Si particles. According to this prior art, the method also requires a control of the cooling of the hypereutectic alloy-hypoeutectic alloy mixture for a length of time to form a semi-solid metal. The generally uniform distribution of primary Si particles is controlled by a more rapid drop in temperature during mixing. No stirring of the melt during cooling thereof is suggested.

According to U.S. Pat. No. 6,880,613, a method for the refining of primary aluminium in hypoeutectic alloys by mixing at least two hypoeutectic alloys into a solid/semi-solid hypoeutectic slurry is described. The method provides control of the morphology, size, and distribution of primary Al in a hypoeutectic Al—Si casting by mixing a hypoeutectic Al—Si liquid with solid hypoeutectic Al—Si particles to impart desirable mechanical properties. In one embodiment of this prior art, small solid chunks of hypoeutectic Al—Si alloy was used to mix with liquid hypoeutectic Al—Si alloy to form a hypoeutectic Al—Si slurry. The generally uniform distribution of primary Al particles is controlled by a more rapid drop in temperature during mixing. No stirring of the melt during mixing is suggested.

OBJECT OF THE INVENTION

The primary object of the invention is to provide a method for rapidly forming a liquid-solid composition wherein solid particles are homogenously dispersed within the volume of the liquid-solid metal alloy. The liquid-solid metal should be given such properties that any formation of a solid dendritic network upon further cooling thereof, and in absence of any further stirring, is avoided.

It is also an object of the present invention to present a method for producing a liquid-solid metal composition that reduces or even removes the need of external cooling of the molten metal or alloy, but still results in a rapid generation of a liquid-solid slurry that can be used, for example, in a subsequent casting process in which a product or semi-product is produced. The invention should also reduce the need of controlling the temperature of the melt during liquid-solid slurry preparation.

It is also an object of the present invention to present a method where a liquid-solid metal composition can be rapidly generated from new compositional combinations of liquid metals or alloys with solid metals or alloys.

It is also an object of the invention to present a method that is both easy to implement and cost effective.

SUMMARY OF THE INVENTION

The object of the invention is achieved by means of the initially defined method, characterised in that the amount of solid metal or alloy is chosen such that a substantial amount of solid particles will be formed in the mixture due to the enthalpy exchange between the solid metal or alloy and the molten metal or alloy, at least a part of the added solid metal or alloy being melted by the heat transferred to it by the molten metal or alloy. In other words, the invention suggests the use of internal cooling instead of external cooling. It is essential for the invention that the amount of added solid metal or alloy is such that it can be concluded that it results in a solidification of a certain fraction of the molten metal, and that this solidification is directly derivable from the addition of the solid metal or alloy. In other words, the amount of solid metal or alloy should be such that, due to the exchange of enthalpy between the solid metal or alloy and the molten metal or alloy, a solidification of the molten liquid or alloy is initiated and a liquid-solid slurry is generated. Accordingly, the charged solid metal or alloy should have a lower temperature than the molten metal or alloy, and, preferably, room temperature. It may, but need not, have the same composition as the molten metal or alloy. Possibly, the mixing is performed in more than one step or sequence. The solid metal or alloy should be dissolvable in the melt, i.e. in the molten metal or alloy. In other words, it could be totally or partially melted and dispersed in the melt during mixing. Preferably, mixing and stirring is performed simultaneously, and the melt is stirred while the solid metal or alloy is charged and while enthalpy exchange is taking place.

It is an essential aspect of the invention that nucleation and initial solidification in the melt is due to an addition of solid metal or alloy, and basically not due to any external cooling. However, this does not rule out the possibility of using external cooling as a supplementary cooling means.

According to a preferred embodiment of the invention, the amount of solid metal or alloy is chosen such that the amount of solid particles formed due to said enthalpy exchange is at least 1 wt %, preferably at least 5 wt %, more preferably at least 10 wt %, and most preferably at least 15 wt % or, even better, at least 20 wt %. It is crucial that the amount of, or fraction, of solid particles, and the distribution thereof in the melt, is such that it guarantees a suppression of the generation of a dendritic network or structure upon further cooling, and solidification thereof. It should be noted that, after an initial generation of solid particles, which is the direct result of the solidification during stirring and with the inventive addition of solid metal or alloy, further growth of the solid particles through coarsening, without any significant formation of dendrites, will take place upon further cooling of the slurry, even without further stirring thereof.

According to a preferred embodiment the amount of solid metal or alloy is chosen such that the amount of solid particles formed due to said enthalpy exchange is not more than 65 wt %, preferably not more than 50 wt %, and most preferably not more than 30 wt %. Higher percentage of solid fraction will render the slurry less easy to deform and to use in any further process, for example a casting process.

According to one embodiment, the solid metal or alloy charged to the vessel is charged as at least one individual piece loaded into the vessel. The solid metal or alloy can be charged stepwise, even using different metal compositions at each step. The liquid metal or alloy charged to the vessel can also be charged stepwise, even using different metal compositions at each step.

According to a further preferred embodiment, the stirring is performed by means of a mechanical stirrer, or several mechanical stirrers, and the solid metal or alloy charged to the vessel is connected to the stirrer or at least to one of the stirrers. The solid metal or alloy could, for example be formed by one or more pieces connected to the stirrer by means of welding or the like. The solid metal or alloy could also, for example be continuously or stepwise supplied into the melt through, or from, the stirrer or stirrers via a channel or the like extending through the stirrer. The stirrer itself could be formed by a material having a substantially higher melting point than the liquid metal or alloy in order not to be melted due to the heat from the melt. The solid metal or alloy could preferably be an operative part of the stirrer, thereby actually contributing to the stirring effect, apart from its function as an enthalpy exchanger. Possibly, the stirrer in its entirety could be formed by the solid metal or alloy that is to be melted during the enthalpy exchange according to the invention. It is preferred that the stirring is performed by means of mechanical stirring. However, the stirring can possibly also be performed by electromagnetic stirring or by a combination of mechanical stirring and electromagnetic stirring. This could e.g. be the case when the solid metal or alloy is continuously fed into the melt through or from the stirrer or stirrers during slurry preparation.

According to the invention, a hypoeutectic semi-solid metal slurry can be generated by mixing a liquid hypoeutectic metal alloy with a eutectic or hypereutectic solid metal alloy from the same alloy system by controlling the amount and the initial temperatures of the charged liquid and solid metals or alloys. Such an example could be an addition of hypereutectic Al—Si alloy (e.g. 13% Si) to a hypoeutectic Al—Si alloy (e.g. 5% Si) to form a hypoeutectic Al—Si slurry. Stirring is necessary in order to achieve a homogenous distribution of the solid particles inside the slurry. A hypereutectic semi-solid metal slurry can be generated by mixing a liquid hypereutectic alloy with a eutectic or hypereutectic solid alloy from the same alloy system by controlling the amount and the initial temperatures of the charged liquid and solid metals or alloys. Such an example could be an addition of hypereutectic Al—Si alloy (e.g. 13% Si) to a hypereutectic Al—Si alloy (e.g. 20% Si) to form a hypereutectic Al—Si slurry. Stirring is also necessary to achieve homogenous distribution of the solid particles inside the slurry. A semi-solid metal slurry can also be generated by mixing a liquid metal or alloy with a solid metal or alloy from different alloy systems by controlling the amount and the initial temperatures of the charged liquid and solid metals or alloys. Such an example could be an addition of solid Mg—Zn alloy (e.g. 7% Zn) to a liquid Mg—Al alloy (e.g. 9% Al) to form a Mg—Al—Zn slurry. Stirring is necessary to achieve homogenous distribution of the solid particles inside the slurry.

The invention also relates to a device for implementing the method according to the invention, characterised in that it comprises a vessel and a stirrer, and that the solid metal or alloy is attached to the stirrer.

The invention also relates to a device for implementing the method according to the invention, characterised in that it comprises a vessel and at least one stirrer, and that the at least one stirrer is provided with a channel for feeding the solid metal or alloy therethrough into the molten metal or alloy.

Further features and advantages of the present invention will be presented in the following detailed description of the invention as well as in the appended dependent claims.

BRIEF DESCRIPTION OF THE DRAWINGS

A detailed description of a preferred embodiment of the inventive method and device will follow, based on the appended drawing, on which.

DETAILED DESCRIPTION OF THE INVENTION

Figure 1:
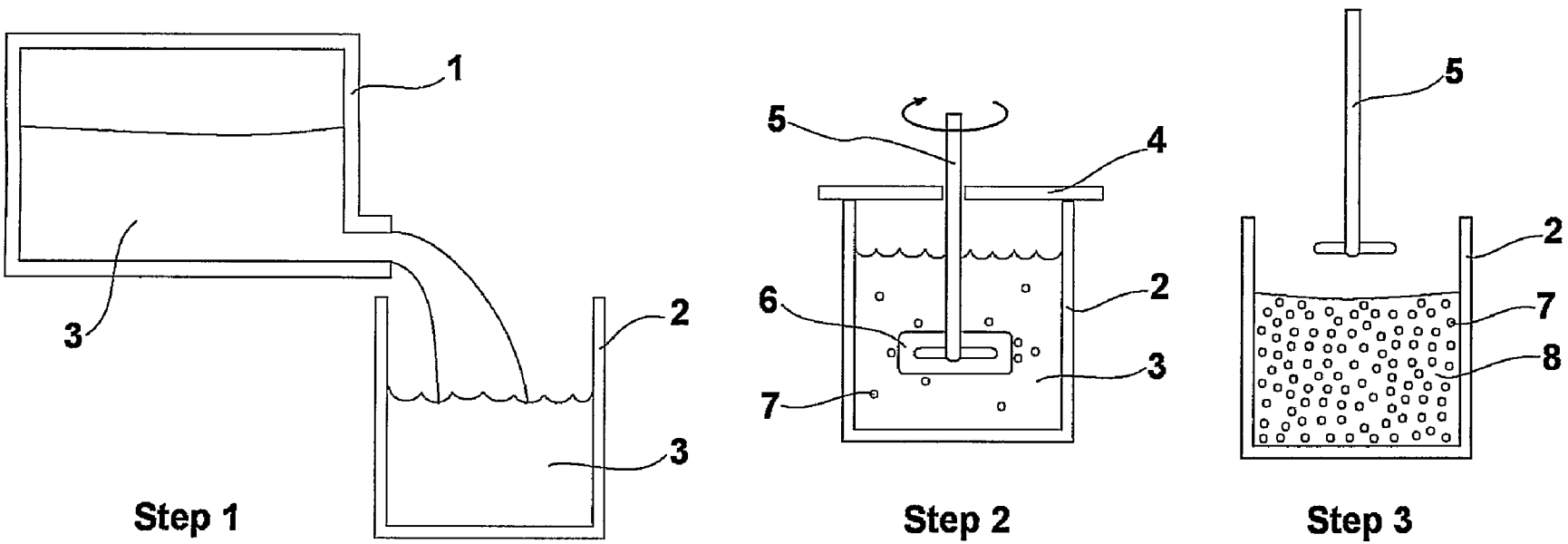
FIG. 1 is a schematic drawing illustrating the process of the inventive method

FIG. 1 shows three individual steps in a preferred embodiment of the inventive method. Step 1 shows a melting furnace 1, and a tundish 2 that forms the vessel according to the invention. A melt 3 of molten metal or alloy is generated in the furnace 1 and is then poured into the tundish 2. The wall of the tundish 2 comprises or is covered with a heat insulating material.

Step 2 shows a subsequent step of the inventive method, and also a preferred embodiment of the inventive device. Step 2 shows the tundish, or vessel, 2 of step 1. The tundish 2 is provided with a cover 4, and a mechanical stirrer 5 extends through the cover 4 and is immersed in the melt 3.

At least one piece of solid metal or alloy 6 is attached to the stirrer 5. The solid metal or alloy 6 is dissolvable in the melt 3, i.e. it will be totally or partially melted by the heat from the melt and be distributed in the melt 3. The solid metal or alloy 6 can also be a metal composite, i.e. it contains a certain amount of non-metallic particles inside the metal matrix. On the other hand, the lower temperature of the solid metal or alloy 6 will result in an enthalpy exchange with the molten metal or alloy 3 and in nuclei formation in the melt 3. The nucleation is supposed to take place on the outer surface or near the outer surface of the solid metal piece or alloy piece 6. However, thanks to the rotation of the stirrer 5, these new formed nuclei 7 will be thrown out from the surface of the solid metal piece or alloy piece 6 and be distributed relatively uniformly in the melt, thereby forming a generally homogenous slurry. The stirring also increases the heat exchange rate between the charged liquid and solid metals or alloys, thereby making it possible to generate large amount of slurry in a short time.

Step 3 shows that the stirrer 5 has been removed from the melt 3, which is now a liquid-solid metal composition or semi-solid slurry 8, comprising a molten phase as well as solid particles 7.

The amount of solid particles 7 formed in the melt due to the enthalpy exchange between the charged molten metal or alloy 3 and the charged solid metal or alloy 6 is high enough to substantially prevent the growth of a dendritic structure in the liquid-solid metal composition 8 upon further cooling during any subsequent processing step; such as a casting operation.

The solid fraction of the slurry 8 can be controlled by adjusting the compositions, the initial temperatures of the charged liquid and metal or alloy and the charged solid metal or alloy as well as the mass ratio between the charged liquid and solid metals or alloys. In many cases it is desirable to control the solid fraction of the slurry 8 in the range between 20 to 30%. At this solid fraction the slurry 8 already has a sufficient amount of solid particles or grains for preventing any dendrite growth, but still has enough fluidity to be poured out of the tundish 2 into a casting device. The slurry 8 could then be poured into a continuous casting device (not shown) for feedstock production. The slurry 8 could also be used for any other type of casting operation, for example so-called rheocasting or for semi-solid strip casting.

EXAMPLES

The following examples illustrate the present invention and are not intended to limit the same.

Example 1

Figure 2:
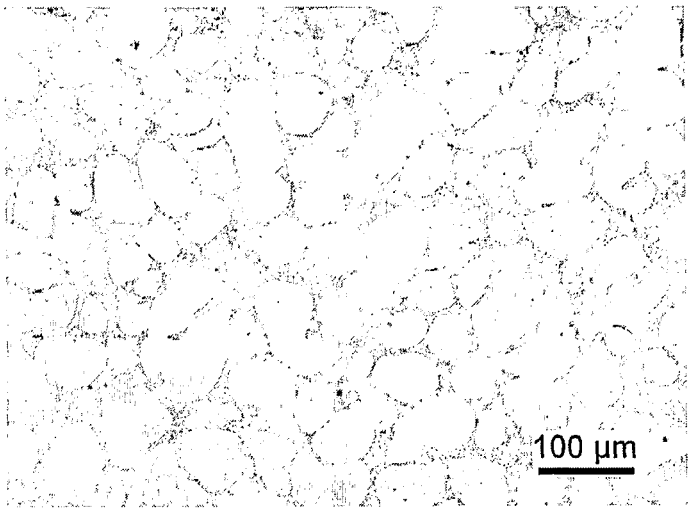
FIG. 2 is a photomicrograph of a metal composition of Example 1, comprising primary solids formed during mixing and secondary solid phase formed during quenching after stirring

Al-7% Si alloy slurry produced by mixing a melt with a solid of different composition The following is a detailed description of a method for producing Al—Si alloy slurry containing about 7 weight percent Si with degenerate dendritic structures, with reference to FIG. 2.

2013 g of Al—Si alloy stock containing about 6.5 weight percent Si was melted in a clay-graphite crucible inside a resistance furnace. The crucible was about 165 mm tall, with a 110 mm inner diameter, and a 15 mm wall thickness. When the Al-6.5% Si alloy was totally melted and had reached 630° C., about 10° C. above its liquidus temperature, the furnace power was turned off. 197 g of solid Al—Si alloy containing about 12 weight percent Si was attached to a mechanical stainless steel stirrer. The Al-12% Si alloy, attached to the stirrer, both initially at room temperature, was immersed into the melt. Stirring continued for 37 seconds. The Al-12% Si, no more attached to the stirrer, was homogeneously mixed with the original melt. Then the stirrer was removed from the melt. Consequently, a new Al—Si alloy containing about 7 weight percent Si was formed. Mainly due to the enthalpy exchange between the liquid and the added solid, the resulting temperature of the Al-7% Si alloy after stirring was 593° C. A small amount of the slurry was taken out from the crucible and quenched in cold water. The microstructure obtained is shown in FIG. 2.

Example 2

Figure 3:
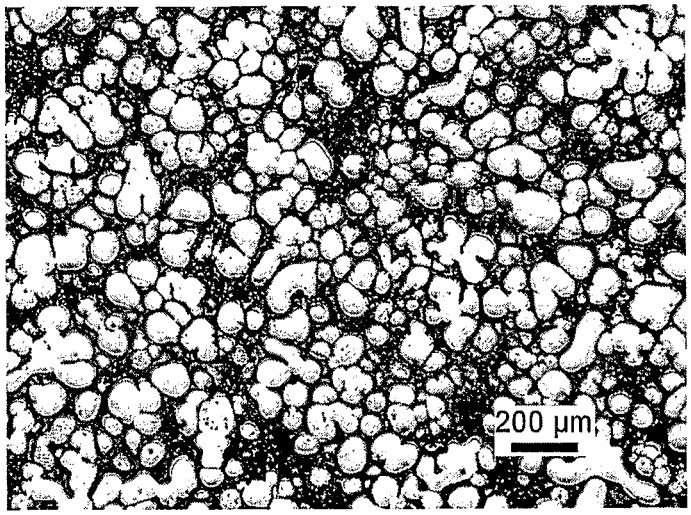
FIG. 3 is a photomicrograph of a metal composition of Example 2, comprising primary solids formed during mixing and secondary solid phase formed during quenching after stirring

Mg-9% Al alloy slurry produced by mixing a melt with a solid of same composition The following is a detailed description of a method for producing Mg—Al alloy slurry containing 9 weight percent Al with degenerate dendritic structures, with reference to FIG. 3.

101 g of Mg—Al alloy stock containing 9 weight percent Al was melted in a steel crucible inside a resistance furnace. The crucible was about 150 mm tall, with a 30 mm inner diameter, and a 1.5 mm wall thickness. When the Mg-9% Al alloy was totally melted and had reached 605° C., about 10° C. above its liquidus temperature, the furnace power was turned off. A total of 15 g of room temperature solid Mg—Al alloy containing 9 weight percent Al was added three times as individual pieces, and manually stirred between each addition by a thin steel rod. The total stirring time was about 2 minutes. Mainly due to the enthalpy exchange between the liquid and the added solid, the resulting temperature of the Mg-9% Al alloy after stirring was 576° C. A small amount of the slurry was taken out from the crucible and quenched in cold water. The microstructure obtained is shown in FIG. 3.

Example 3

Al-20% Si alloy slurry (also containing a small amount of Mg) produced by mixing a melt with a solid from a different alloy system.

Figure 4:
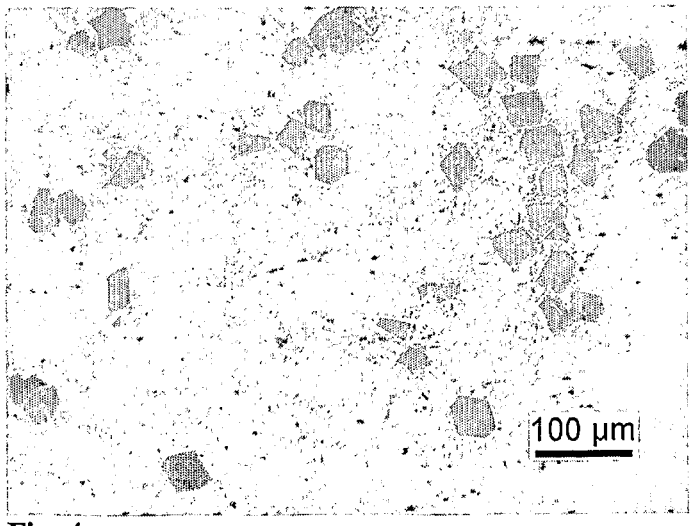
FIG. 4 is a photomicrograph of a metal composition of Example 3, comprising primary solids formed during mixing and secondary solid phase formed during quenching after stirring

The following is a detailed description of a method for producing Al—Si alloy slurry containing about 20 weight percent Si and also a small amount Mg with non-dendritic primary silicon particles, with reference to FIG. 4.

1913 g of Al—Si alloy stock containing about 21 weight percent Si was melted in a clay-graphite crucible inside a resistance furnace. The crucible was about 165 mm tall, with a 110 mm inner diameter, and a 15 mm wall thickness. When the Al-21% Si alloy was totally melted and had reached 721° C., the furnace power was then turned off. 101 g of solid Al—Mg alloy piece containing about 1 weight percent Mg was attached to a mechanical stainless steel stirrer. The Al-1Mg alloy piece, attached to the stirrer, both initially at room temperature, was immersed into the melt. Stirring continued for 27 seconds. The Al-1Mg alloy piece, no more attached to the stirrer, was homogeneously mixed with the original melt. Then the stirrer was removed from the melt. Consequently, a new Al—Si alloy containing about 20 weight percent Si and a small amount of Mg was formed. Mainly due to the enthalpy exchange between the liquid and the added solid, the resulting temperature of the Al-20% Si alloy slurry after stirring was about 630° C. A small amount of the slurry was then taken out from the crucible and quenched in cold water. The microstructure obtained is shown in FIG. 4.

It should be realised that alternative further embodiments of the invention will be obvious for a person skilled in the art. However, the scope of the present invention is not delimited to the specific embodiment described here, but only by what is stated in the appended patent claims.

For example, it should be understood that it is not only the amount of solid metal or alloy to be mixed with the molten metal or alloy that is important to the outcome of the method according to the invention, but also the initial temperature of the solid metal or alloy and the molten metal or alloy, as well as the stirring time, holding time etc. Typically, the initial temperature of the molten metal or alloy should be slightly above its liquidus temperature, whereas the initial temperature of the solid metal or alloy should be close to room temperature, in order to promote efficient nucleation. Further, the time involved in the process may also affect the final fraction as well as the shape of the solid particles in the slurry, due to diffusional processes when the system approaches thermodynamical equilibrium.

The invention claimed is:

1. A method of producing a liquid-solid metal composition (8), comprising:

charging a vessel (2) with a molten metal or alloy (3), charging the vessel (2) with a solid metal or alloy (6), stirring the molten metal or alloy (3) upon cooling thereof, wherein an amount of solid metal or alloy (6) is chosen such that at least 1 wt % of solid particles (7) will be formed in the melt (3) due to an enthalpy exchange between the solid metal or alloy (6) and the molten metal or alloy (3), at least a part of the added solid metal or alloy (6) being melted by the heat transferred to the solid metal or alloy by the molten metal or alloy (3), such that the liquid-solid metal composition is formed, the solid metal or alloy (6) is dissolvable in the molten metal or alloy (3), the stirring is performed by a mechanical stirrer (5) and the solid metal or alloy (6) is charged to the vessel (2) via the stirrer (5), the solid metal or alloy (6) is attached directly to the stirrer (5), and the thus formed liquid-solid metal composition, including formed solid particles, is provided to a casting operation.

2. The method according to claim 1, wherein essentially all the added solid metal or alloy (6) is melted by the heat transferred to the solid metal or alloy by the molten metal or alloy (3).

3. The method according to claim 1, wherein the amount of solid metal or alloy (6) is chosen such that the amount of solid particles (7) formed due to said enthalpy exchange is at least 5 wt %.

4. The method according to claim 1, wherein the amount of solid metal or alloy (6) is chosen such that the amount of solid particles (7) formed due to said enthalpy exchange is at least 10 wt %.

5. The method according to claim 1, wherein the amount of solid metal or alloy (6) is chosen such that the amount of solid particles (7) formed due to said enthalpy exchange is not more than 65 wt %.

6. The method according to claim 1, wherein the amount of solid metal or alloy (6) is chosen such that the amount of solid particles (7) formed due to said enthalpy exchange is not more than 50 wt %.

7. The method according to claim 1, wherein the solid metal or alloy (6) charged to vessel (2) is charged as at least one individual piece into the vessel (2).

8. The method according to claim 1, wherein a mixture of molten metal or alloy and the solid metal or alloy (6) is subjected to a supplementary external cooling beside the cooling effect of the solid metal or alloy (6).

9. The method according to claim 1, wherein the charged solid metal or alloy (6) has the same composition as the charged molten metal or alloy (3).

10. The method according to claim 1, wherein the charged solid metal or alloy (6) has a different composition than the charged molten metal or alloy (3).

11. The method according to claim 1, wherein the amount of solid particles (7) formed in the melt (3) upon cooling thereof due to the cooling effect of the added solid metal or alloy (6) is high enough to substantially prevent the growth of a dendritic structure in the liquid-solid metal composition (8) upon further cooling thereof without aid of any further added solid metal or alloy (6).

12. The method according to claim 1, wherein the produced liquid-solid metal composition is a hypoeutectic liquid-solid metal composition (8), that the molten metal or alloy is a molten hypoeutectic metal or alloy (3), and that the solid metal or alloy (6) is a eutectic or hypereutectic solid metal or alloy (6) from the same alloy system as said molten metal or alloy (3).

13. The method according to claim 1, wherein the produced liquid-solid metal composition is a hypereutectic liquid-solid metal composition (8), that the molten metal or alloy is a molten hypereutectic metal or alloy (3), and that the solid metal or alloy (6) is a eutectic or hypereutectic solid metal or alloy (6) from the same alloy system as said molten metal or alloy (3).

14. The method according to claim 1, wherein the solid metal or alloy (6) is of a different alloy system than that of said molten metal or alloy (3).

15. The method according to claim 1, wherein the liquid-solid metal composition (8) has a spherical or non-dendritic structure.

* * * * *